US008101032B1

(12) United States Patent
Brandenburg et al.

(10) Patent No.: US 8,101,032 B1
(45) Date of Patent: Jan. 24, 2012

(54) ETHANOL BASED GEL FUEL FOR A HYBRID ROCKET ENGINE

(75) Inventors: John E. Brandenburg, Middleton, WI (US); Matthew D. Fox, Coral Springs, FL (US); Rodrigo H. Garcia, Temple Terrace, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 908 days.

(21) Appl. No.: 12/122,408

(22) Filed: May 16, 2008

Related U.S. Application Data

(60) Provisional application No. 60/938,839, filed on May 18, 2007.

(51) Int. Cl.
*C06B 47/00* (2006.01)
*D03D 23/00* (2006.01)

(52) U.S. Cl. ..... 149/1; 149/2; 149/109.6

(58) Field of Classification Search ..... 149/1, 2, 149/22, 109.6
See application file for complete search history.

(56) References Cited

U.S. PATENT DOCUMENTS 3,839,107 A * 10/1974 Clark et al. ..... 149/22
3,899,374 A * 8/1975 Sylkhouse ..... 149/2
4,997,457 A 3/1991 Mitsusawa et al.
6,101,808 A 8/2000 Knuth et al.
6,984,273 B1 1/2006 Martin et al.
2003/0217504 A1 11/2003 Merdjan et al.

FOREIGN PATENT DOCUMENTS

WO PCTCA199800562 12/1998
WO PCTUS2000020065 2/2001

* cited by examiner

*Primary Examiner* — Aileen B Felton

(74) *Attorney, Agent, or Firm* — Brian S. Steinberger; Joyce P. Morlin; Law Offices of Brian S. Steinberger, P.A.

(57) ABSTRACT

A cost-effective, renewable ethanol-based solid fuel compound, and method of making the fuel for hybrid rocket engines. Gelling agents, preferably methylcellulose can be used in conjunction with calcium acetate or calcium acetate alone make a stiff plastic out of ethanol to improve its properties for hybrid rocket engine. The increased stiffness of an ethanol-based fuel gel, increases yield stress that allows rapid acceleration of rockets. The low cost bio-fuel based on solidified ethanol rather than expensive petroleum derived substances lowers the cost of volume rocket launches, lowers the cost of access to orbit and provides safer sounding rocket flights into space. The resulting raw gel can further be mixed with a cross linking compound and water to form a stiffer material. Alternatively, the resulting raw gel can be frozen by liquid nitrogen.

15 Claims, 7 Drawing Sheets

EXHAUST VELOCITY VS. EXPANSION RATIO

EXHAUST VELOCITY VS. EXPANSION RATIO

SETUP AND TRUST STAND OF THE HYBRID ROCKET ENGINE

THRUST CURVE

AFTER 2 SECONDS

AFTER 7 SECONDS

AFTER 12 SECONDS

AFTER 15 SECONDS

AFTER 19 SECONDS

ETHANOL BASED GEL FUEL FOR A HYBRID ROCKET ENGINE

This application claims the benefit of priority to U.S. Provisional Patent Application Ser. No. 60/938,839 filed May 18, 2007.

FIELD OF INVENTION

This invention relates to rocket fuel technology and, in particular to, ethanol-based solid rocket fuel and methods of making the fuel for hybrid rocket engines.

BACKGROUND AND PRIOR ART

Hybrid rocket propulsion, because of its safety and potential to create high performance rocket motors, offers a wonderful opportunity for the construction and test firing of both rocket motors and actual flight vehicles. Hybrid rockets use a liquid oxidizer, usually non-toxic nitrous oxide, and a solid fuel, such as rubber, to create a rocket engine. The advantage of this is that both fuel and oxidizer are safe until the oxidizer is injected into the engine.

Ethanol is a vital new renewable fuel for the future, and when derived from sugar cane can return 8:1 in energy invested in its recovery. Ethanol also has a long and illustrious record as a rocket fuel, being the fuel for the German V-2 missile developed by Werner Von Braun, as well as the Jupiter C that orbited the first United States satellite, and the American Redstone Rocket that carried the first two Americans into space, Alan Shepard and Gus Grissom. Thus, ethanol is an excellent rocket fuel and it is desirable for use in a hybrid rocket.

Hybrid rockets use a liquid oxidizer and solid fuel, so, in order to use ethanol in a hybrid rocket, it must be made into a solid material, such as the commercially available product known as STERNO®, a petroleum based solid fuel which uses calcium acetate as a gelling agent. The commercial STERNO® fuel product has been demonstrated to be a good hybrid fuel; however, commercial STERNO® gel does not have sufficient strength to hold its shape during the acceleration of the rocket burn.

Methyl Hydroxyl Propyl Cellulose (MHPC) has been made into a gel with ethanol as a fuel medium, as described in U.S. Patent Application Publication 2003/0217504. However, this fuel medium is limited to a "fuel for cooking and barbeque/fire lighter units.", abstract, and has nothing to do with solid fuel for hybrid rockets.

Ethanol based liquid fuels are currently being used for internal combustion engines, as discussed in WO1998/056878 to Craig, et al. but this has nothing to do with solid fuel for hybrid rockets.

Liquid monopropellant fuels are also known and reported in WO2001/009063 and U.S. Pat. No. 6,984,273 to James D. Martin et al.

A cryogenic solid hybrid rocket engine and method of propelling a rocket is reported in U.S. Pat. No. 6,101,808 to Knuth et al. The solid fuel for a hybrid rocket is achieved by taking the fuel that is liquid or gaseous at room temperature and then freezing it into a solid for use in a hybrid rocket. This is a very expensive and energy intensive fuel preparation process.

None of the prior art references is entirely without technical merits. However, there remains a need for low cost, easily prepared and efficient solid rocket fuels for hybrid rocket engines. The present invention provides the needed solid fuel.

SUMMARY OF THE INVENTION

The primary objective of the present invention is to provide a cost-effective, solid ethanol-based fuel and method of making the fuel for a hybrid rocket engine.

A second objective of the present invention is to use methyl cellulose and other gelling agents such as epoxy polymer alone or in conjunction with calcium acetate or calcium acetate alone to make a stiff plastic out of ethanol to improve its properties for hybrid rocket engines.

A third objective of the present invention is to leverage recent advances in the use of ethanol, a low cost bio-fuel rather than more expensive petroleum derived substances as a fuel for hybrid rocket engines.

A fourth objective of the present invention is to provide a low-cost ethanol based solid fuel for hybrid rocket engines to lower the cost of volume rocket launches.

A fifth objective of the present invention is to provide a low-cost fuel to make it possible to have much lower cost access to orbit for universities, and other institutions.

A sixth objective of the present invention is to provide low-cost, safer sounding rocket flights into space.

A seventh objective of the present invention is to additionally add a cross linking agent and water to the raw gel to enhance the properties of the hybrid rocket fuel.

A solid, cost-effective, ethanol based fuel for a hybrid rocket engine comprising approximately 85% wt. ethanol fuel, approximately 5% wt. water; and a gelling agent having approximately 10% methyl cellulose, wherein the fuel is useful for a rocket engine, with a mechanically strong fuel grain combined with a low molecular weight exhaust having a high mass percentage of ethanol, and the fuel is both non-toxic and environmentally friendly.

The gelling agents can be an alkali metal acetate in combination with methyl cellulose.

The alkali metal acetate is at least one of calcium acetate, magnesium acetate and potassium acetate.

The gelling agent can include water and a cross linking agent. The cross linking agent can be diethylene glycol dimethacrylate.

The gelling agent can be frozen by liquid nitrogen.

A method of forming a solid ethanol based fuel for a hybrid rocket engine can include the steps of mixing ethanol and water to form mixture (I); mixing a gelling agent that includes methyl cellulose to mixture I to form mixture (II) and stirring mixture II to form a stiff plastic, solid ethanol-based fuel for a hybrid rocket engine.

The gelling agent can include an alkali metal acetate. The alkali metal acetate is selected from at least one of: calcium acetate, magnesium acetate and potassium acetate.

The mixing in step c) occurs for minutes and at ambient conditions. The fuel is safe to handle prior to injection of a oxidizer into the hybrid rocket engine.

The method can include the steps of adding water and a cross linking agent to mixture II. The cross linking agent can be diethylene glycol dimethacrylate. The method can include the step of freezing the gelling agent with liquid nitrogen.

Further objects and advantages of this invention will be apparent from the following detailed description of the presently preferred embodiments, which are illustrated schematically in the accompanying drawings.

DESCRIPTION OF THE PREFERRED EMBODIMENTS

Figure 1:
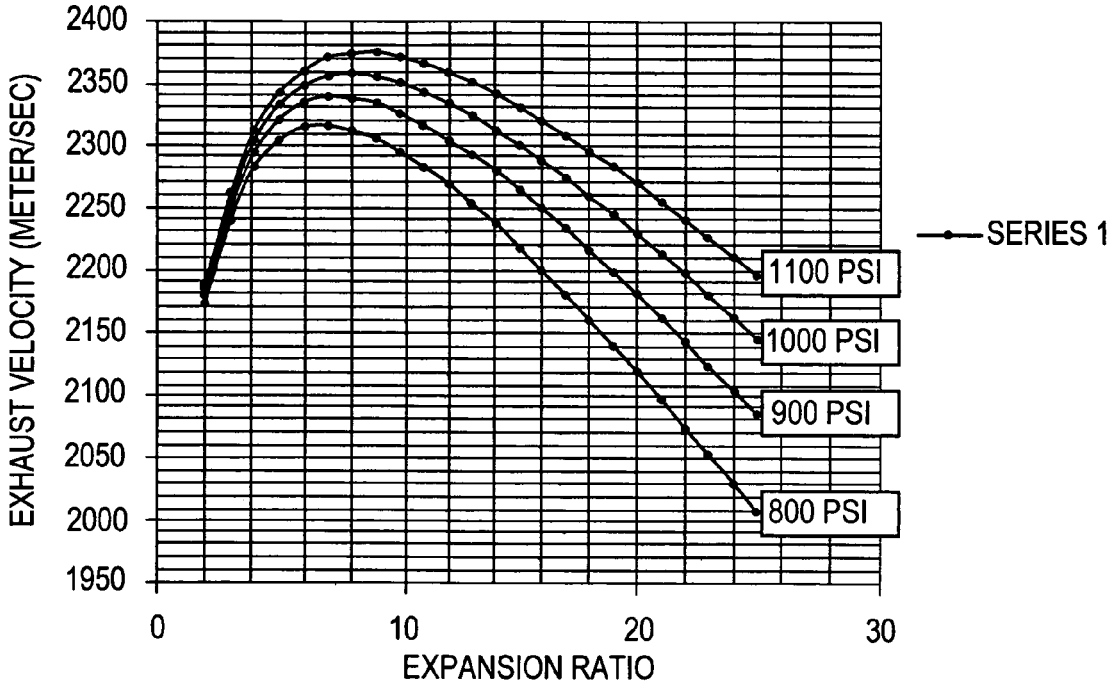
FIG. 1 shows a graph demonstrating the performance of the engine represented by the Exhaust Velocity (meters/sec) vs. Nozzle Expansion Ratio.

Before explaining the disclosed embodiments of the present invention in detail, it is to be understood that the invention is not limited in its application to the details of the particular arrangements shown since the invention is capable of further embodiments. Also, the terminology used herein is for the purpose of description and not of limitation.

The acronyms listed are defined below.

Tc=Combustion chamber temperature c* Combustion chamber characteristic velocity=

Isp Specific impulse

Vx Exhaust velocity

According to the present invention, the objectives stated above are met by increasing the stiffness of an ethanol-based fuel gel, with increased yield stress, that allows rapid acceleration of rockets.

First, a brief discussion of the properties of ethanol fuels. Gelatinized ethanol fuel has high specific impulse (Isp) when mixed with liquid oxygen, generating 300 seconds of propulsion per kilogram of fuel. Thus, the use of gelatinized ethanol as fuel is given serious consideration for use in a hybrid rocket.

Key to the development of a rocket is the use of hybrid rocket fuel based on ethanol with gelling agents. This fuel is now named "Knightro-Gel" in honor of the University of Central Florida football team, the Golden Knights. The gelling agents were chosen both to create a mechanically strong fuel grain and to create a low molecular weight exhaust with high mass percentage of ethanol. Preferred formulations are in excess of 80% ethanol and 7% water to optimize Isp and ensure good stability. Fuel capacity can be controlled to adjust radiative heat transfer from the flame to the fuel, and an important factor in controlling the fuel regression rate. Burn data has demonstrated high regression rate and highly efficient burns with approximately 4:1 weight ratio of oxidizer to fuel. Thermo-chemical code runs have estimated an Isp of 225 seconds of propulsion per kilogram of fuel.

For purposes of illustrating the present invention, but not as a limitation, three embodiments will be described in detail below.

First Embodiment

Laboratory Ignition of Ethanol Gel Fuel

An ethanol gel fuel has been burned several times in the laboratory. Fuel is being burned in the development program using nitrous oxide oxidizer with a commercial solenoid valve fitted to a paint ball compressed gas bottle. The bottle is rated at 1000 psi but is only being pressurized to 800 psi. Thrust is being measured using a load cell. The thrust is borne on ceramic tile held at the base of the thrust stand.

The thrust stand consists of a 3 inch diameter PVC pipe which holds 2 paint ball type bottles, a 12 ounce (oz.) bottle of highly pressurized nitrous oxide and a 9 oz bottle of low pressure nitrous oxide. Ignition is achieved by a pyrotechnic torch with electric ignition at the nozzle while opening a the low pressure (30 psi) nitrous oxide bottle which, floods the interior void of the Knightro-Gel fuel grain. Once the flame ignites on the outside of the engine at the nozzle, the flame front rapidly moves inwards to ignite the inner surface of the fuel. Once the flame front is firmly established the main chamber, the 800 pounds per square inch (psi) nitrous oxide supply is opened by an electric valve.

Second Embodiment

Outdoor Rocket Launch

This embodiment is intended for outdoor application. An ethanol gel fuel has been burned several times in an outdoor site. A single stage rocket can include a length of approximately 3 ft. and diameter of 3 inches. Burn time of its engine is presently estimated to be 20 seconds with a thrust of 50 lbs. The ignition can use a small nitrous capsule and radio controlled valve with an electric pyrotechnic device. A second radio controlled valve can control the main oxidizer supply, which can be cutoff if the rocket is observed to go off course. On board telemetry will provide acceleration and image data during the flight.

Third Embodiment

Launch from Kennedy Space Center

Presently, access to instructional rocket launches at the Kennedy Space Center (KSC) is provided by a limited supply of Super-Loki rockets. The super Loki is configured to provide a student launch capability while meeting range safety for KSC.

Most of the hybrid rocket engine that are operating right now are based on the use of nitrous oxide liquid or gas as the oxidizer and HTPB or PVC, as the solid fuel element. An example of the successful use of the HTPB and nitrous combination is the X prize flight to space. The relative safety of hybrid rocket motors as well as the elimination of the turbo pump machinery required for liquid rockets; makes the former a very attractive choice for a student project.

Range safety is satisfied by the Super Loki rockets because they burn up all their fuel before they reach the end of the spiral launch rail. This property means that they leave the launch rail on a ballistic trajectory while spinning rapidly along their axis. This means they must travel a path that lies within a small cone from the end of the launch rail. Thus the Super Loki is considered to be range-safe in the sense of being certain to stay on the planned trajectory.

The launch vehicle flight safety can be achieved by the use of non toxic fuel and oxidizer and the fact that hybrid rockety engine can be shut down after it has been ignited. This can occur because the oxidizer flow to the thrust chamber can be shut off if the rocket goes off course, thus ending the rocket thrust and causing the rocket to stop accelerating or even release a parachute in addition to ending its acceleration.

The Golden Knight 1A is intended to be the upper stage of an evolved launch vehicle of multiple stages, with the ultimate goal of a three stage hybrid rocket that can reach altitudes in excess of 100 km. The utility of such a vehicle to the University of Central Florida for space experiments is obvious. Not only will such a vehicle be able to loft student or faculty experiments into space for periods of minutes, thus space qualifying them, but is will also provide safe, hands on experience for students in rocket launches.

The team at the University of Central Florida decided to explore new options of fuel combinations. One the promising fuels that we finally settled on is a mixture of Plexiglas, gelled ethanol as the solid fuel, and nitrous oxide as the oxidizer. On this merit, it was decided to draw comparisons between the HTPB, and the Plexiglas plus Knightro-Gel combination.

Table 1 shows some of the results obtained from the study at four different combustion chamber pressures. The new combination of fuel designated in the table by the letter B. The results show an increase in the exhaust velocity with the use of the Plexiglas and Knightro-Gel combination, directly increasing the produced thrust generated by the hybrid engine. There is also a rise in the specific impulse, by an average of about 14 seconds.

TABLE 1

Combustion results; A: HTPB + Nitrous, B: Plexiglas + Knightro-Gel + Nitrous

| | A $T_c$ (K) | B $T_c$ (K) | A c* (m/s) | B c* (m/s) | A $I_{sp}$ (s) | B $I_{sp}$ (s) | A $V_{ex}$ (m/s) | B $V_{ex}$ (m/s) |
|---|---|---|---|---|---|---|---|---|
| 800 psi | 2321 | 2851 | 1416.16 | 1482.94 | 221.8 | 234.2 | 2176.85 | 2298.56 |
| 900 psi | 2312 | 2853 | 1415.33 | 1482.63 | 223.7 | 236.4 | 2195.73 | 2320.16 |
| 1000 psi | 2322 | 2855 | 1414.57 | 1482.3 | 225.3 | 238.3 | 2211.22 | 2338.8 |
| 1100 psi | 2322 | 2857 | 1413.66 | 1481.99 | 226.7 | 240 | 2223.73 | 2355.49 |

The optimum expansion ratio can be extracted from these data to design the best performing engine for the given set of values. For the 800 psi operating pressure that was used in the Florida Space Institute laboratories, the data shows an optimum nozzle expansion ratio of 6.63, while this value increased with the increase in pressure values.

Figure 2:
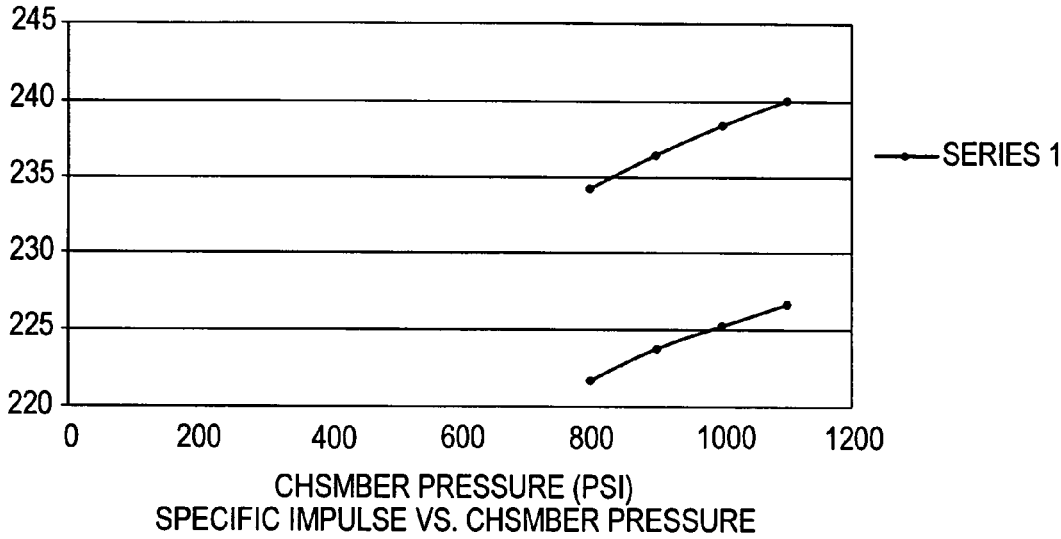
FIG. 2 shows a graph of the values of Specific Impulse (sec.) vs. Chamber Pressure (psi).

The values of the specific impulse are plotted in FIG. 2 for an illustration of the increase in the specific impulse when using the Plexiglas, Knightro-Gel combination as oppose to the use of the HTPB.

Figure 3:
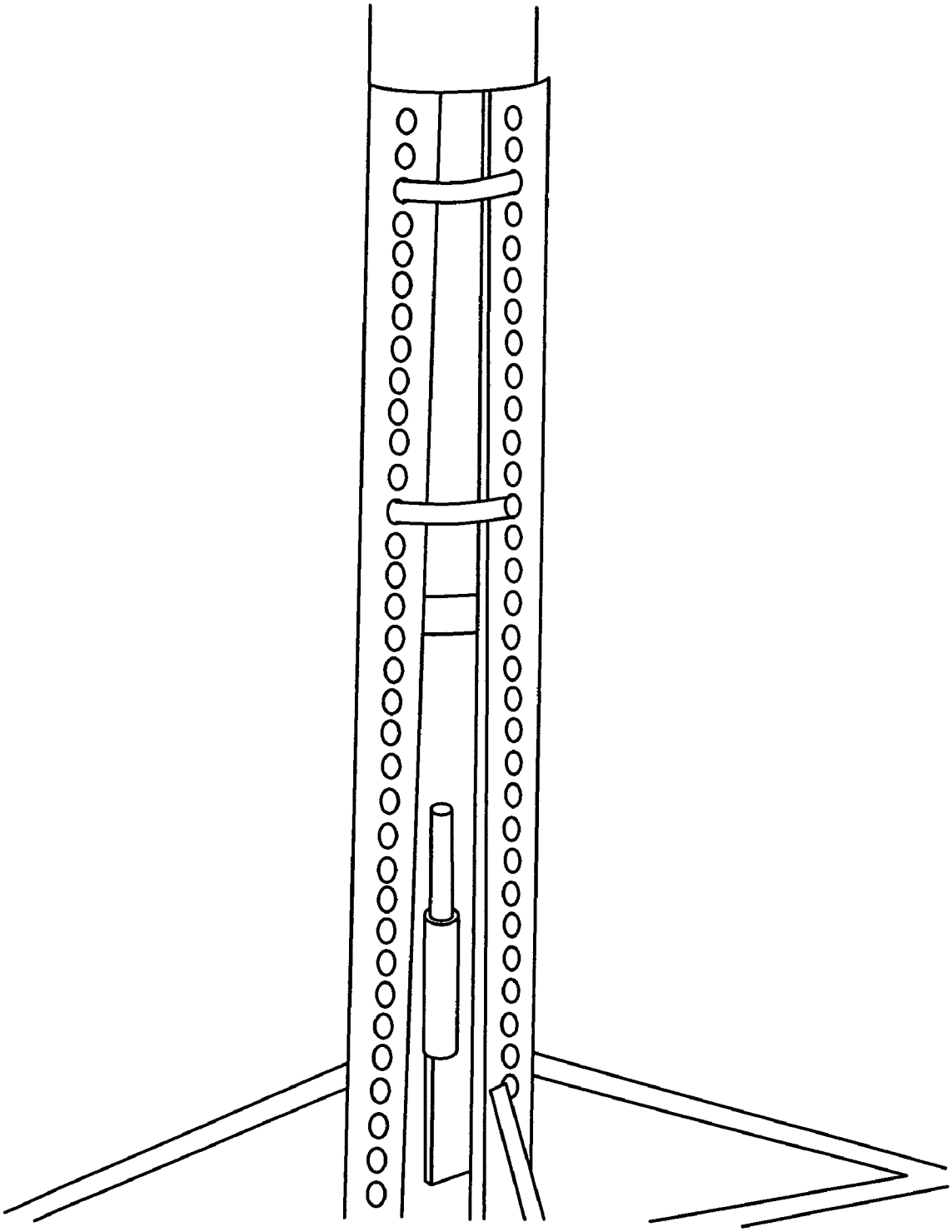
FIG. 3 shows a setup and thrust stand of the Hybrid Rocket Engine.

A thrust stand was constructed for the test operation of the hybrid rocket engine. The whole engine is contained in PVC pipes as shown in FIG. 3. The PVC piping was covered with heat resisting spray to prevent any overheating, but the flame from the engine is firing away from the containment. For measurement of the thrust a hole was made right on top of the fuel tank. A load cell that contains a strain gauge was mounted top of the fuel tank, as shown on the left side of the picture in FIG. 3.

Figure 4:
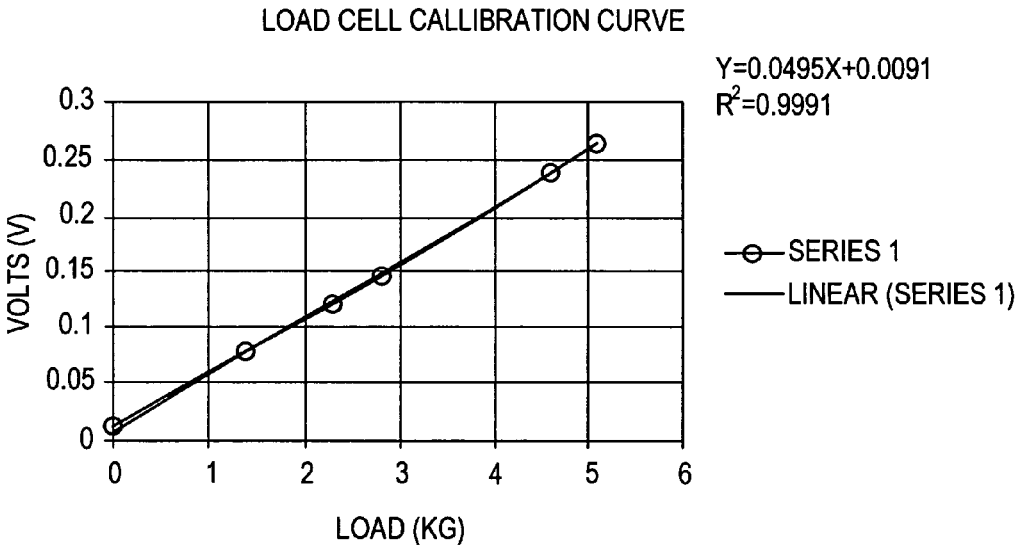
FIG. 4 shows a graph of the Load Cell Calibration Curve for Volts (v) vs. Load (kg).

The load cell is connected to data acquisition box that is in turn connected to a computer that gives a voltage reading. Any movement of the fuel tank would cause a deflection in the strain gauge on the load cell causing a change in the voltage reading that is read on the computer screen and recorded. A calibration curve had to be obtained for the load cell to be able to interpret the voltage readings to measurements of force. The calibration of the load cell was done and the results plotted on the graph shown in FIG. 4.

The performance of the engine was evaluated with further calculations that would prove the validity of our design. Further analysis was done on the engine to come up with the most suitable design, FIG. 1 shows a graph demonstrating the performance of the engine represented by the exhaust velocity plotted against the nozzle expansion ratio, in each case pressure value.

4 along with the appropriate linear regression trend line. Each voltage point represents a different weight that was plotted on an excel graph, and an equation was obtained representing the relation between voltage and weight, regression coefficient of 0.9991 which is a good value in this case.

Figure 5:
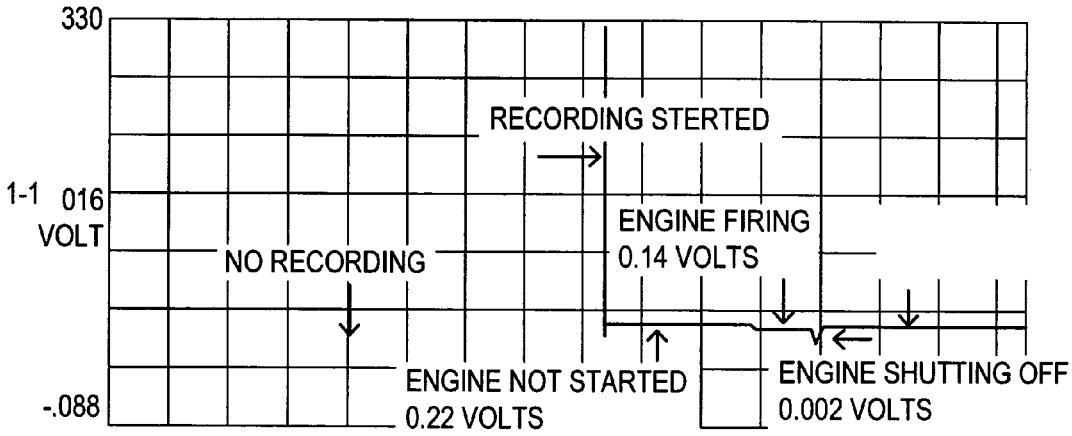
FIG. 5 shows a graph of the Thrust Curve.
Figure 6A:
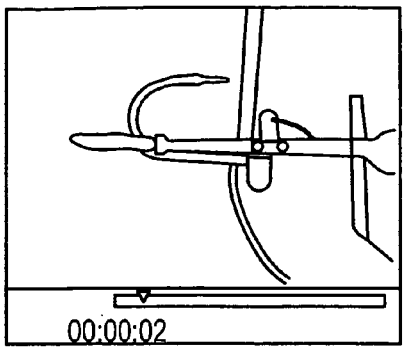
FIGS. 6*a*, 6*b*, 6*c*, 6*d* and 6*e* show snapshots of the Hybrid Rocket Engine at different time intervals of burn.
Figure 6B:
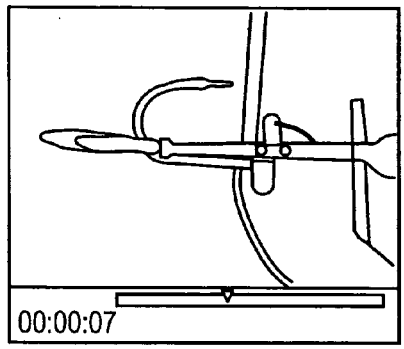
Figure 6C:
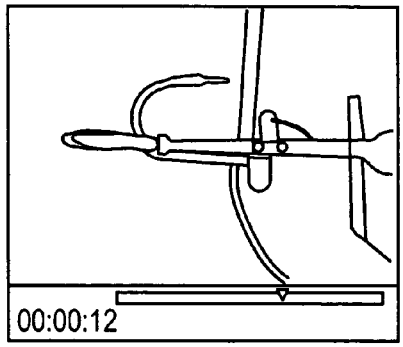
Figure 6D:
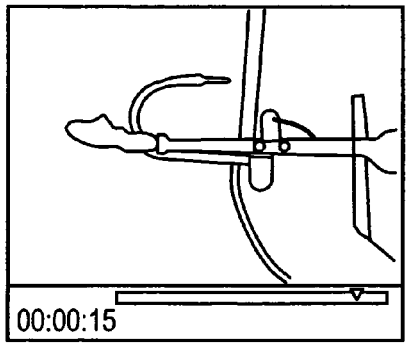
Figure 6E:
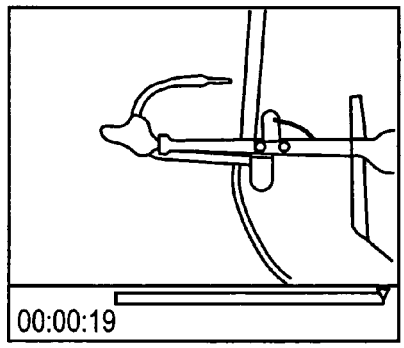

The thrust test was done using a 35 grams tube of Plexiglas that has an inner diameter of 1 centimeter and an outer diameter of 1.6 centimeter. Then the inside of the tube was swabbed with the Knightrogel which was observed to help the burn significantly, because of the presence of alcohol. The thrust curve was obtained upon firing of the engine, and is shown in FIG. 5.

The first horizontal line is showing the load cell reading before the recording starts. This is followed by a spike that marks the noise in the system when the load cell is turned on and the recording started. The former spike shows a value of 0.22 volts. The next spike shows the load cell reading when the engine fired with a voltage reading of 0.14 volts, giving a difference of 0.08 volts for a thrust value in excess of the weight of the engine itself. Plugging the voltage reading into the calibration equation returns a net thrust value of 1.45 kg of force, or 14.22 Newton, plus the weight of the engine which was measured to be 0.7 kg, making the total net thrust equal to 21.084 Newton.

FIG. 6 shows snapshots of the engine in the firing mode starting at 2 seconds into the burn. The hybrid rocket engine has a total burn time of 19 seconds with a burn rate of 0.694 grams per second.

The data shown in table 2 and table 3 presents a detailed analysis of the combustion process in the chamber as well as the exhaust results. After examining the results from these two tables it can be concluded that the carbon monoxide portion is dominant over the carbon dioxide portion in both the combustion chamber as well as the exhaust. This is considered to be a good result, since carbon monoxide weighs considerably less than the carbon dioxide. Lower molecular weight in the exhaust means higher exhaust velocity and consequently an increase in thrust.

TABLE 2

Chamber Results

| Temperature (K) | Pressure (Psi) | Cp/Cv (γ) | Molecular Weight (grams/mole) |
|---|---|---|---|
| 2855 | 1000 | 1.2527 | 24.411 |

| Chamber Species | # of Moles | Molecular Name |
|---|---|---|
| N2 | 0.79483 | Molecular Nitrogen |
| H2O | 0.31212 | Water |
| CO | 0.53095 | Carbon Monoxide |
| $CO_2$ | 0.11152 | Carbon Dioxide |
| $H_2$ | 0.21264 | Molecular Hydrogen |
| HO | 0.00344 | Hydroxyl |
| H | 0.00778 | Atomic Hydrogen |
| NO | 0.00061 | Nitrogen Oxide |
| $O_2$ | 4.59E-05 | Molecular Oxygen |
| O | 7.75E-05 | Atomic Oxygen |
| N | 7.90E-07 | Atomic Nitrogen |
| NHO | 7.55E-07 | |
| CHO | 1.26E-05 | |
| $NH_3$ | 2.37E-05 | Ammonia |
| $NH_2$ | 2.99E-06 | Amide |
| NH | 5.88E-07 | |
| CNH | 8.82E-06 | |
| CNHO | 2.02E-06 | Hydrogen Isocynate |
| $CH_2O$ | 2.23E-06 | Formaldehyde |

TABLE 3

| Exhaust Results | | | |
|---|---|---|---|
| Temperature (K) | Pressure (Psi) | $C_p/C_v$ (γ) | Molecular Weight (grams/mole) |
| 1215 | 14.69 | 1.2897 | 24.486 |

| Chamber Species | # of Moles | Molecular Name |
|---|---|---|
| $N_2$ | 0.79515 | Molecular Nitrogen |
| $H_2O$ | 0.21745 | Water |
| CO | 0.43207 | Carbon Monoxide |
| $CO_2$ | 2.10E-01 | Carbon Dioxide |
| $H_2$ | 0.31295 | Molecular Hydrogen |
| $CH_4$ | 4.82E-06 | Methane |
| $NH_3$ | 1.42E-05 | Ammonia |

The hybrid rocket engine described above shows a lot of promise. It is showing higher performance than the regular motors using HTPB as fuel. The addition of the ethanol greatly improved the combustion. The specific impluse has improved by an average of about 14 seconds. The motor produced 21.084 Newton of thrust using the ingredients discussed in this paper. The results shown in this experiment show that there is also room for more improvement with more experiments to optimize the engine performance to reach its best potential, especially by increasing the amount of ethanol added to the Knightro-Gel.

Figure 7:
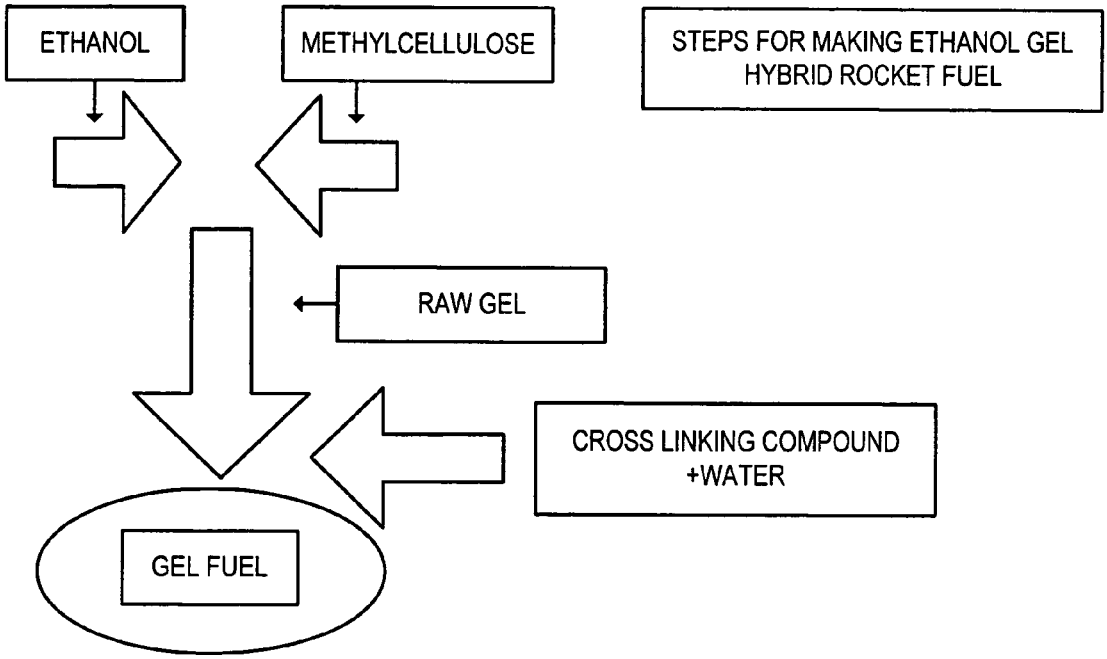
FIG. 7 is a flow chart of the main steps for making ethanol Gel Hybrid Rocket Fuel.

FIG. 7 is a flow chart of the main steps for making ethanol Gel Hybrid Rocket Fuel. The raw gel suffers from poor yield strength and can be remedied by the addition of water and a small amount of a cross linking agent, such as but not limited to diethylene glycol dimethacrylate, or similar compounds. Alternatively, the gel can be frozen with liquid nitrogen before being loaded to achieve a necessary stiffness.

Table 4 lists a preferred embodiment of the components of the fuel for rockets.

TABLE 4

| Component | Weight (Wt) % |
|---|---|
| ethanol | 85% |
| Methyl Cellulose | 10% |
| Water | 5% |

Although the preferred gelling agent is described above, the invention can use other gelling agents such as an epoxy polymer by itself or in combination with methyl cellulose.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A solid, cost-effective, ethanol based fuel for a hybrid rocket engine comprising:

a) approximately 85% wt. ethanol fuel;

b) approximately 5% wt. water; and c) a gelling agent having approximately 10% methyl cellulose, wherein the fuel is useful for a rocket engine, with a mechanically strong fuel grain combined with a low molecular weight exhaust having a high mass percentage of ethanol, and the fuel is both non-toxic and environmentally friendly.

2. The solid, ethanol based fuel of claim 1, wherein the gelling agents includes:

an alkali metal acetate in combination with methyl cellulose.

3. The solid, ethanol-based fuel of claim 2, wherein the alkali metal acetate is at least one of calcium acetate, magnesium acetate and potassium acetate.

4. The solid, ethanol based fuel of claim 1, wherein the gelling agent further includes:

water and a cross linking agent.

5. The solid, ethanol based fuel of claim 4, wherein the cross linking agent is:

diethylene glycol dimethacrylate.

6. The solid, ethanol based fuel of claim 1, wherein the gelling agent is frozen by liquid nitrogen.

7. A method of forming a solid ethanol based fuel for a hybrid rocket engine comprising the steps of:

a) mixing ethanol and water to form mixture (I)

b) mixing a gelling agent that includes methyl cellulose to mixture I to form mixture (II);

c) stirring mixture II to form a stiff plastic, solid ethanol-based fuel for a hybrid rocket engine.

8. The method of claim 7, wherein the gelling agent further includes:

a alkali metal acetate.

9. The method of claim 8, wherein the alkali metal acetate is selected from at least one of: calcium acetate, magnesium acetate and potassium acetate.

10. The method of claim 7, wherein the mixing in step c) occurs for minutes and at ambient conditions.

11. The method of claim 7, wherein the fuel is safe to handle prior to injection of a oxidizer into the hybrid rocket engine.

12. The method of claim 7, further comprising the step of:

adding water and a cross linking agent to mixture II.

13. The method of claim 12, wherein the cross linking agent is:

diethylene glycol dimethacrylate.

14. The method of claim 7, further comprising the step of:

freezing the gelling agent.

15. The method of claim 14, wherein the freezing step includes the step of:

freezing the gelling agent with liquid nitrogen.

* * * * *